US006544007B2

(12) United States Patent
Gethöfer et al.

(10) Patent No.: US 6,544,007 B2
(45) Date of Patent: Apr. 8, 2003

(54) RADIAL PISTON PUMP WITH NOISE REDUCTION

(75) Inventors: Frank Gethöfer, Friedrichshafen (DE); Wolfgang Reuter, Florstadt (DE); Ralf Zischka, Schwäbisch Gmünd (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 09/865,057

(22) Filed: May 24, 2001

(65) Prior Publication Data

US 2002/0023533 A1 Feb. 28, 2002

(30) Foreign Application Priority Data

Jun. 2, 2000 (DE) ..... 100 27 435

(51) Int. Cl.[7] ..... F04B 1/04
(52) U.S. Cl. ..... 417/273; 92/72; 92/172; 92/501
(58) Field of Search ..... 417/273; 92/72, 92/85 R, 162 R, 172, 490, 492, 501

(56) References Cited

U.S. PATENT DOCUMENTS 2,818,816 A * 1/1958 Christenson ..... 417/273
3,519,370 A * 7/1970 Bleuel ..... 417/273
4,363,607 A * 12/1982 Eichele et al. ..... 417/273
5,383,770 A * 1/1995 Hiashara ..... 417/273

FOREIGN PATENT DOCUMENTS

| | | |
|---|---|---|
| DE | 1 770 489 | 7/1958 |
| DE | 42 41 825 A1 | 6/1994 |
| DE | 44 25 929 A1 | 1/1996 |
| DE | 43 36 673 C2 | 8/1999 |

* cited by examiner

*Primary Examiner*—Charles G. Freay
*Assistant Examiner*—John F Belena
(74) *Attorney, Agent, or Firm*—Davis & Bujold, P.L.L.C.

(57) ABSTRACT

Described is a radial piston pump with a pump housing (3), which has a plurality of cylinder bores (5) arrayed in star shape around a cam (4), for the reception of pistons (6) and possesses inlet (7) and outlet (8) when penetrate to each cylinder inner chamber (9) with a therein compressible working volume. In accord with the invention, each cylinder inner chamber (9) is provided with at least one relief opening, which connects the working volumes during a compression stroke of the piston (6) with a space of lesser pressure for the reduction of the pressure gradient and also thereby reducing the noise of the pump.

14 Claims, 5 Drawing Sheets

RADIAL PISTON PUMP WITH NOISE REDUCTION

FIELD OF THE INVENTION

The invention concerns a radial piston pump, with a pump housing, which possesses a plurality of cylindrical bores for the reception of pistons, the bores being arrayed in a star-shape around a cam, and the pump further possessing intake and outlet openings which penetrate to the inner chamber of each cylinder and thus to the compressed working volume therein.

BACKGROUND OF THE INVENTION

The pistons in the pump housing, which is designed as a stationary cylinder block, are displaced by the rotating cam mounted on the drive shaft. The flow of pressurized medium in the pump, as a rule, is controlled by suction and pressure valves. Another pump concept operates by means of intake suction slots and with valving on the pressure side, similar to that mentioned above.

Radial piston pumps of the above mentioned method of construction are well known in the current state of the technology. One disadvantage of the known radial piston pumps is the noise, since upon the conveyance of a pressure medium, a strong pressure impulse occurs in the inner chamber of the piston, which generates a generally unpleasantly loud noise. By such an abrupt pressure stroke, a steep gradient with a high pressure peak is produced, which exceeds the allowable output pressure in the plenum chamber of the pump by several times. These impact pressures increase themselves as a matter of principle with increasing speed of rotation. The pressure impact of all pistons generate the noise level, which then emanates from the housing wall as air borne noise. For the solution of this problem, a multiplicity of different proposals within the state of the technology have been made known.

For instance, in this direction, a proposal has been made to the effect that the pump housing be provided with an insulating coating or even, in another way, be encapsulated against noise. The necessary monetary and space requirements are substantial.

DE 42 41 825 A1 contends, as a fundamental measure, that the noise essentially forms at those points where very high pressures occur and thus sharp force gradients are generated. Since these gradients appear especially at the base of the piston, this proposal suggests that by the intentional implantation of elasticity at the piston, that is, more precisely, at the connection between the piston and the pin bearing, both the force gradients and the noise intensity will be diminished.

DE 43 36 673 C2 describes a pump, the main feature of which contends, that between the piston and the slide elements which are on the contact surface of the eccentric cam, an annular spring can be installed which encircles the cam. The pistons then springingly abut the cam, so that at the start of their outward sliding movement, the pistons can have any abrupt cam impulse ameliorated by the spring, thus diminishing the pressure peaks.

A further solution to the problem of diminishing the pump noise is described in DE 44 25 929 A1. This proposal is based on a premise, that the pistons are to be provided with compensating pressure, an additional oil source, which is in communication with a circumferential conduit. By this means, each piston receives a modifying intake of oil from the compensation space, so that uniform pressure chamber filling can take place with a minimum amount of noise.

Since, however, these above mentioned designs of the radial piston pumps have not resulted in the expected noise reduction with reasonable manufacturing costs, it is the purpose of the present invention to make available a radial piston pump which, particularly during a compression stroke of the piston, reduces the pressure gradients within the inner cylinder chamber, and thus makes the pump quieter.

This purpose is achieved by a radial piston pump having the features of claim 1 while advantageous embodiments are to be found in the subsequent subordinate claims.

SUMMARY OF THE INVENTION

The main feature of the new kind of pump is now found therein, in accord with the invention, that the compressible working volume is connectable to a space of lesser pressure by means of at least one relief opening. By this means, the pressure gradient in the cylinder inner chamber, during the compressing stroke of the piston, is immediately modified even as it originates, and thus, a significant noise reduction of the pump is advantageously achieved. The number of the cylinders of a pump, so equipped with a relief valve, is dependent upon the current demands of the application. Preferably, every cylinder should be equipped with at least one such relief opening.

An advantageous embodiment of the invention is the construction of a chamfer on the forward edge of the piston, which coacts with the inlet opening. This chamfer can be formed around the entire circumference of the piston, or only at that part which coacts with the inlet opening. As a compression stroke proceeds, the piston moves over the inlet opening and tightly closes the same. As the compression stroke continues, the medium enclosed within the cylinder interior compresses itself as the working volume.

The chamfer on the piston prevents, at this point, a too sudden an increase in pressure in the cylinder interior, since between the inlet opening and the now tapered rim-section of the piston, the pressure medium, for a short instant, can back flow into a space of lesser pressure located at the outer approach to the inlet opening. By this means, the pressure peaking in the cylinder inner chamber is rounded off.

In a particular development of the invention, provisions have been made so that the inlet opening is designed as an inlet window to the inner chamber of the cylinder, whereby the side which lies radially outward therefrom is commonly designated as the control side. "Radial" in this connection refers to the axis of rotation of the radial piston pump. In one embodiment in accord with the invention, the relief opening, is located radially outside of the control side of the inlet window in the pump housing.

This permits the relief opening to be at a greater distance from the axis of rotation of the pump than is the inlet control side, and also allows the relief procedure to begin immediately after the closure of the inlet window by the piston.

The relief opening can be placed in the cylindrical bore at any optional, technically sound position. However, it is particularly recommended that the (at least) one relief opening be placed diametrically opposite to the inlet window in the cylindrical bore. Thereby a spatial separation is advantageously achieved between the suction side of the inlet window and the pressure side located relief opening, which offers a substantial reduction of the pressure gradient.

The relief opening in one embodiment, can be so designed so that essentially it exhibits a mirror image symmetry, whereby the plane of symmetry runs principally perpendicular to the longitudinal axis of the cylinder. The relief opening is then designed as one or more bores, or a slot, or lenticular or the like, wherein the longitudinal axis, for instance that of a slot or the lens, is essentially aligned in the direction of the cylinder axis.

In another particular development, the proposal is made that the relief opening possess an open cross section which is tapered by a narrowing toward the outside. Such a relief may be constructed in the form of a triangle, wherein the apex of the triangle points away from the rotational axis of the pump and toward the outside. Since, at the start of the compression, which coincides with the beginning of the buildup of the pressure gradient, and at the time when the greatest quantity of oil is available in the cylinder interior, then, due to the shape of the relief opening, it is advantageously achieved, that initially a large quantity of oil can escape through the "large" part of the relief opening, i.e. the "base" of the triangle. As the operational stroke of the piston continues, then the available open cross-section for the relief diminishes since, at this point in time, the oil volume in the cylinder inner chamber has already been reduced.

In the following, additional shapes of the relief openings are described, which shapes generally correspond to the outline of a triangle. To accomplish its purpose, the relief opening can, for instance, be comprised of three bores, which are so disposed that the middle points thereof form a triangle.

In a particularly advantageous design of the invention, proposed is, that the relief opening be comprised of two relief opening bores, radially offset one from the other, wherein the radially outward situated bore has a smaller diameter than the inner situated bore. Such a relief opening is technically simple to achieve and is a low cost part of the manufacture. The bores are, in an advantageous manner, drilled in the cylinder wall of the pump housing essentially perpendicular to the longitudinal axis of the cylinder.

The radial distance between the centers of these two relief bores represents approximately a one to three fold diameter of the bore itself so that these bores are placed relatively close to one another. The effect of pressure relief of such located bores corresponds to that of a relief opening with an opening surface, the cross-section of which narrows toward the outside, as this has already been described in the case of a triangular opening.

The relief opening, however, is normally so designed that it exhibits a constant opening. Alternatively, the relief opening can be designed as an orifice with a variable flow opening, so that, for example, a temperature dependent adjustment of the relief opening becomes possible.

A further proposal is, that the relief openings be connected with one another by a circumferentially running annular conduit. By this means the achievement is that the pressure medium exiting from the cylinders, through the relief openings, can be captured and can be utilized once again in the process. The annular conduit can alternatively be provided on the intake side in a connection housing.

In a further development of the invention, the proposal is, that an annular conduit be placed in a separate flange ring. For this purpose, the annular conduit can be manufactured simply and economically as a separate component possibly by machining.

The flange ring would subsequently be pushed onto a connection means on the pump housing on that side of the housing opposite to the suction side.

BRIEF DESCRIPTION OF THE DRAWINGS

Further aims, advantages and designs of the invention will be found in the following description of an embodiment example, which is more closely detailed and shown in the drawings. In this explanatory text and the drawings, all features which are described and/or presented by illustrations and characterizations, for themselves or in optional logical combinations of the object of the invention, are independent of their compilation in the claims and the references thereof. There is shown in:

DETAILED DESCRIPTION OF THE INVENTION

Figure 1:
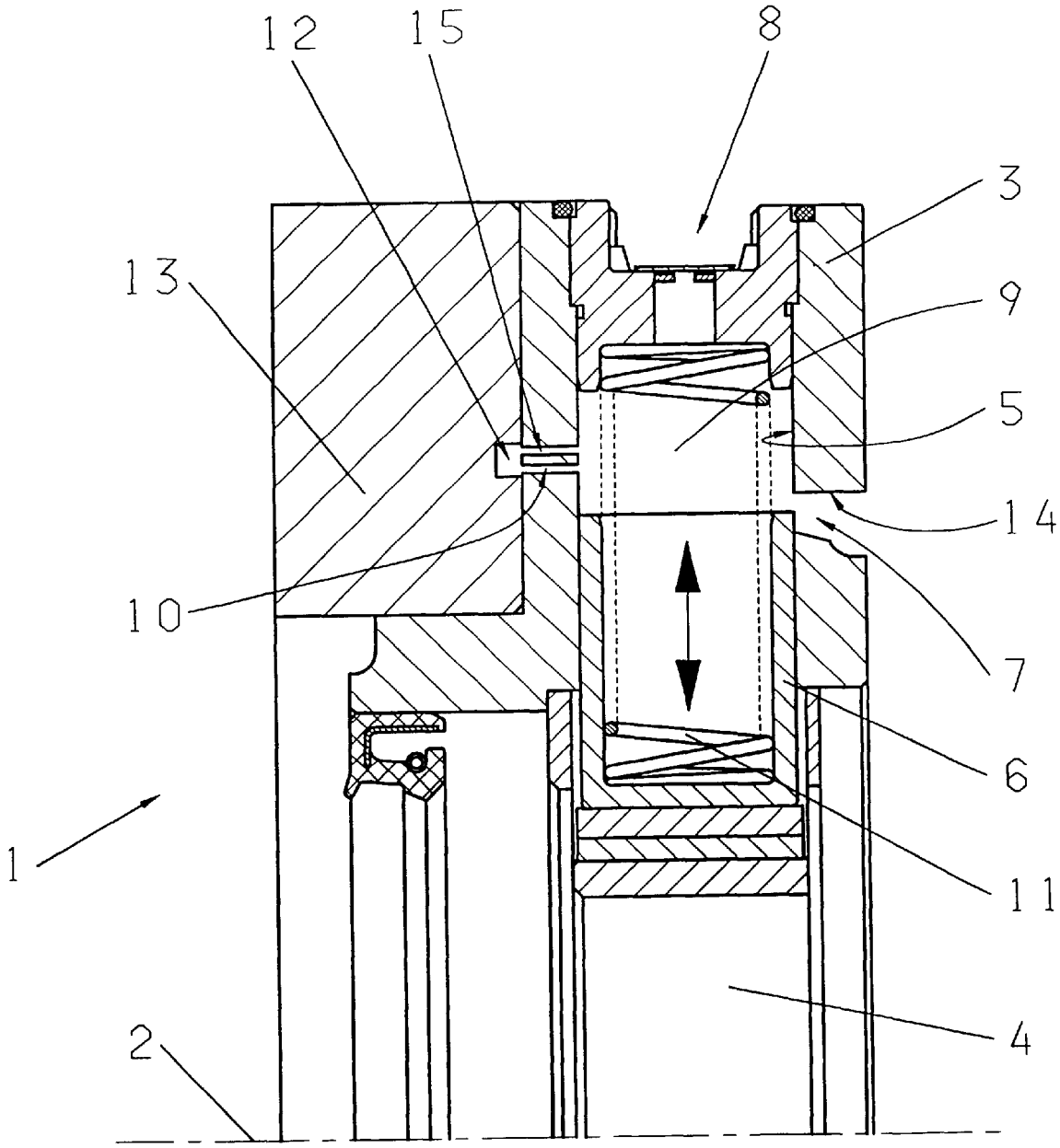
FIG. 1 is a piston-cylinder unit of a radial piston pump, with a first relief opening in accord with the invention, namely, a relief opening bore shown in cross section.

A radial piston pump 1 (FIG. 1) comprises, essentially, a pump housing 3, which incorporates a plurality of cylinder bores 5 which are arrayed in a star-shaped configuration about an axis of rotation 2. The cylinder bores 5 are to receive the pistons 6. These pistons 6 are driven by a cam 4, which cam is placed on a rotatable drive shaft is centered on the said axis of rotation 2. The force, which is generated by the rotating cam 4 and acts radially outward is countered by a compression spring 11 which opposes it inwardly. On the suction side, an inlet window 7 is placed in the pump housing 3, the radial, outer side of which forms the control side 14. During a compression stroke, the piston 6 obstructs the inlet window 7 and, upon the closure thereof, compresses the pressure medium enclosed in the working volume in the cylinder inner chamber 9 so that the pressure medium exits to the pressure side through an outlet opening 8 which is equipped, for instance, with a circumferential band spring.

It is known that a high pressure gradient within the individual inner cylinder chamber, during the compression phase, is responsible for the excessive running noise of a radial piston pump. Experience has shown, that because of the influence of this inner buildup of pressure, an effect is clearly shown on the level of pump noise. On this account, two relief bores 10 and 15 per cylinder are situated, one above the other, and drilled in the cylinder wall, whereby the bores are drilled essentially perpendicularly to the main cylinder bore 5. A ring conduit 12 is provided on the outside of the two bores 10, 15 which are machined into a separate flange ring, possibly by milling. This flange ring 13 can be placed relatively simply on the outer side of the pump housing 3 and be secured in this position. The ring conduit, alternatively, can also be on the suction side of the pump, contained in a connected housing, and instead of the relief openings, small butterfly valves can be employed.

The relief bores 10 and 15 are radially oriented relative to radial axis of rotation 2 and the radially innermost of relief bores 10 and 15 relative to radial axis of rotation 2, shown in FIG. 1 as relief bore 10, being disposed beyond the control side 14 of the inlet window 7, that is, being located radially outwards of control side 14 with respect to axis of rotation 2.

By means of a designed construction of this kind, a cylinder with two relief bores, situated one above the other, a goal is achieved in which during the compression stroke, and following the closure of the inlet window 7 by the piston 6, impact of the stroke, that is, the pressure gradient in the inner cylinder chamber 9 is depressed. As this is carried out, a small volume of leakage of pressure medium escapes through the bores 10 and 15 out of the principal cylinder inner chamber 9. This quantity of loss exists only for a short phase, namely during the span of time from the instant that the piston 6 has closed off the inlet window 7 to the time at which the piston 6, in its further stroke travel has covered over the bores 10 and 15. Since the bores 10 and 15 of all cylinders are interconnected with one another by a circumferential ring conduit 12, the so-called leaked oil can be collected and is available to other cylinders for intake on the suction side.

Experiments with relief bores on the suction side, wherein the relief bores are located radially above the inlet window 7, as seen in the sectional drawing of FIG. 1, have shown a somewhat lesser reduction in noise, but with a measurable increase in leakage. A negative deterioration of the inherent pump intake capability, however, could not be observed.

Figure 2:
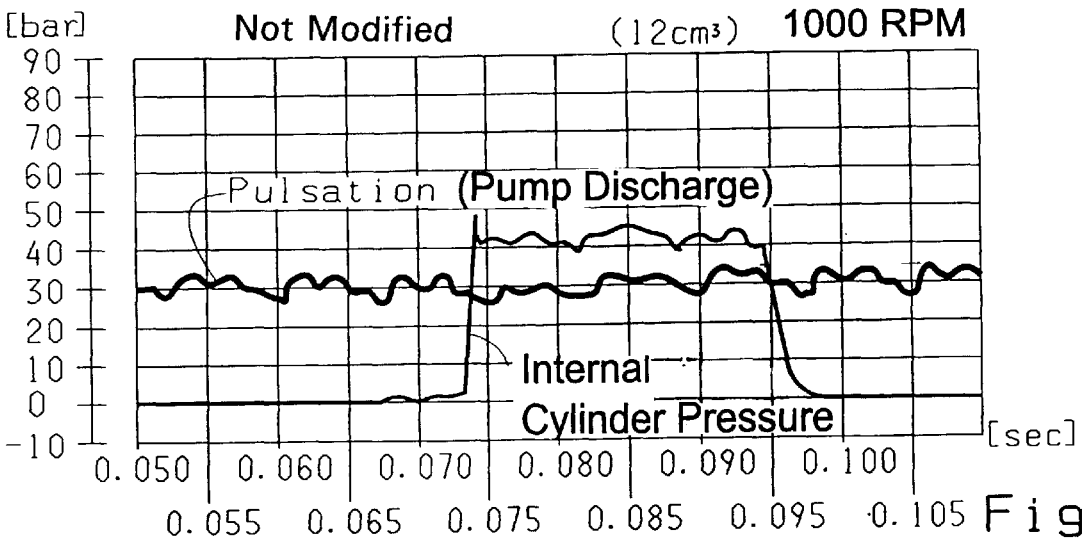
FIGS. 2 to 4 show the curve of the pressure pulsation and the pressure within the cylinder for a first radial piston pump in the non-modified outlet condition, as well as two modified versions with damping bores for an operational point of n=1000 RPM and p=30 bar.

In the curve of pressure pulsation and the inner pressure of a non-modified radial piston pump, as seen in FIG. 2, where the pump has a suction volume of 12 $cm^3$ and an operating point of 30 bar at 1000 RPM, one notes the unmistakable pressure pulsation about the operating pressure of ca. 30 bar, by means of a multitude of small peakings. Especially, at the instant of the inlet closure, an emphasized pressure gradient occurs which makes itself known by a steep pressure climb to about 50 bar.

Figure 3:
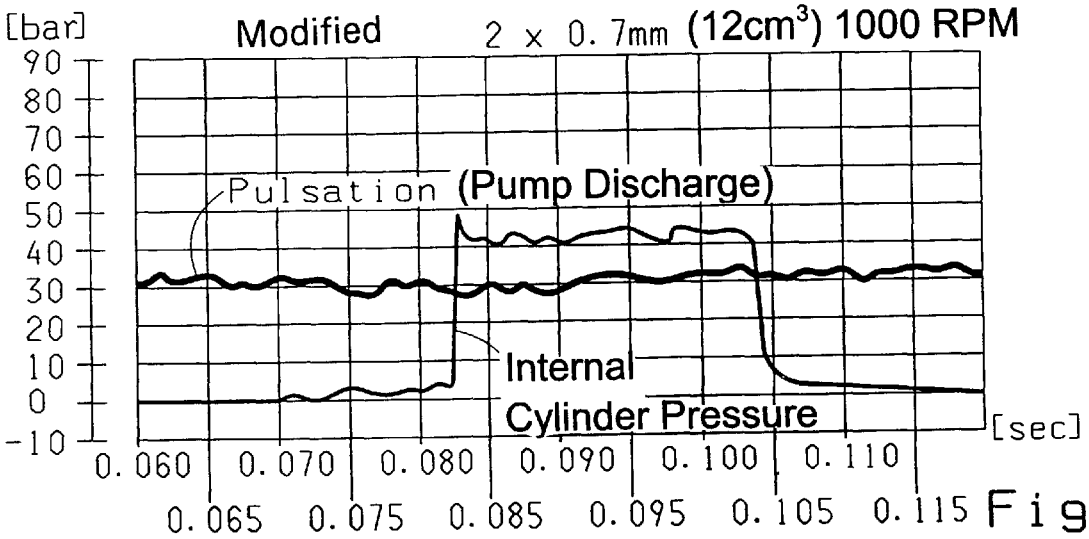

In a modification of the radial piston pump, as shown in FIG. 3, by means of two relief bores, each with a diameter of about 0.7 mm, one recognizes immediately a smaller pressure gradient between the peakings, as well smaller pressure fluctuations in the cylinder inner chamber, which carries through as a diminishing of the pressure pulsation of the pump delivery.

Figure 4:
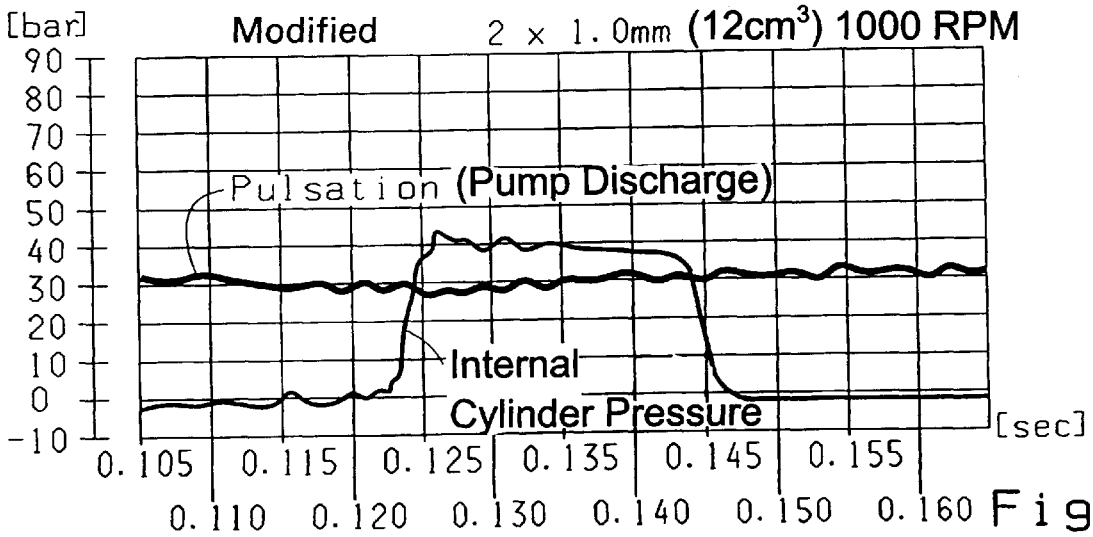

In a modification of the pump with two bores, which is shown in FIG. 4, this time with diameters each of 1.0 mm the pressure peakings are entirely avoided and, at the same time, the pressure pulsations in the inner pump chamber as well as in the pump delivery are substantially evened out.

Figure 5:
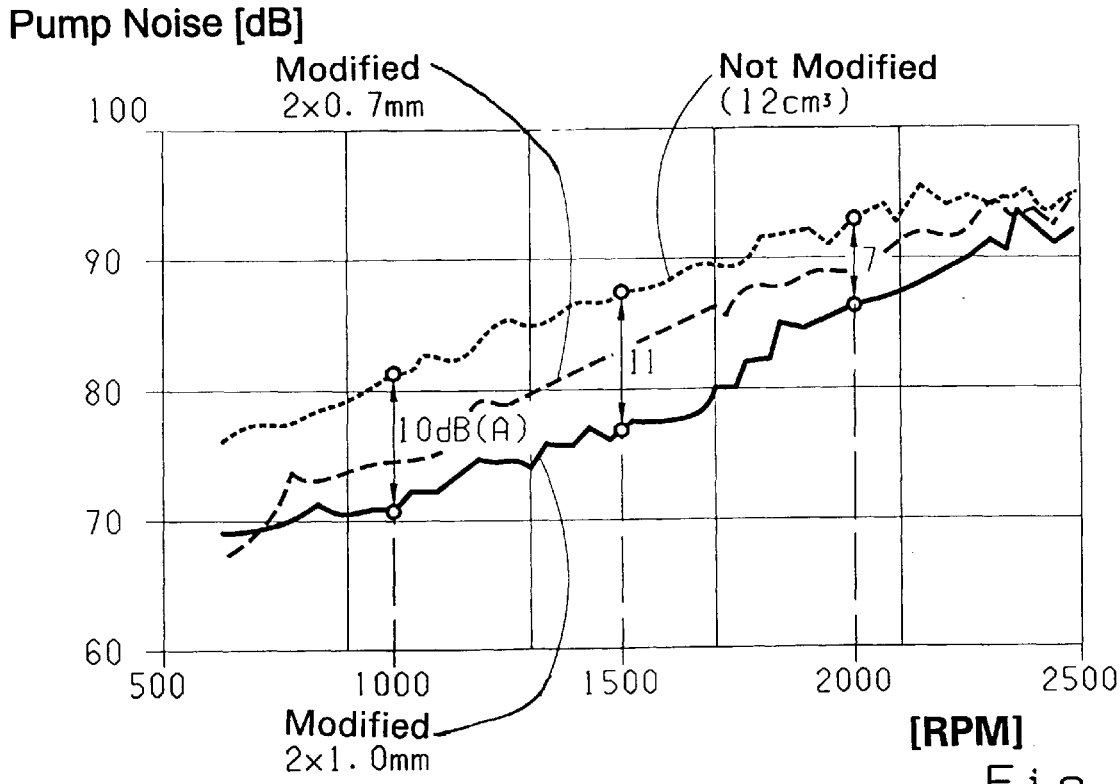
FIG. 5 is the curve of the sound pressure level for a first radial piston pump in the modified version in accord with FIGS. 2 to 4, dependent upon the RPM.

By means of the modifications of the radial piston pump, as is shown in FIG. 5, a reduction in the noise level is attained. This reduction is ascertained by technical measurements dependent upon the bore diameter and the speed of rotation of the pump.

The measurements so taken, show a clear reduction in the total noise level curve of up to 11 dBA as the relief bore diameters increase. In the case of two bores, each of 1.0 mm diameter at 1000 RPM, a noise level reduction of 10 dBA was achieved, at 1500 RPM this dropped to a maximum of 11 dBA and at 2000 RPM the reduction held at 7 dBA, in comparison to the non-modified version. The reduction in the noise level at 1500 RPM by the 11 dBA subjectively represents a 50% decrease in noise. Above about 2500 RPM, practically no action of the damping relief bores can be detected, because the relief action of the bores is negligible, due to the high speed of the piston as well as the insufficient filling of the cylinder in the controlling zone.

This significant lowering of the noise level is brought about by a reduction in the volumetric efficiency of the radial piston pump by means of intended leakage. For compensation of this reduction, an increase in the theoretical compression volumes, for instance from 17 to 22 $cm^3$/revolution was proposed. This increase would be achieved by enlarging the eccentricity of the pump shaft and/or an increase in the diameter of the cylinder bore.

Figure 6:
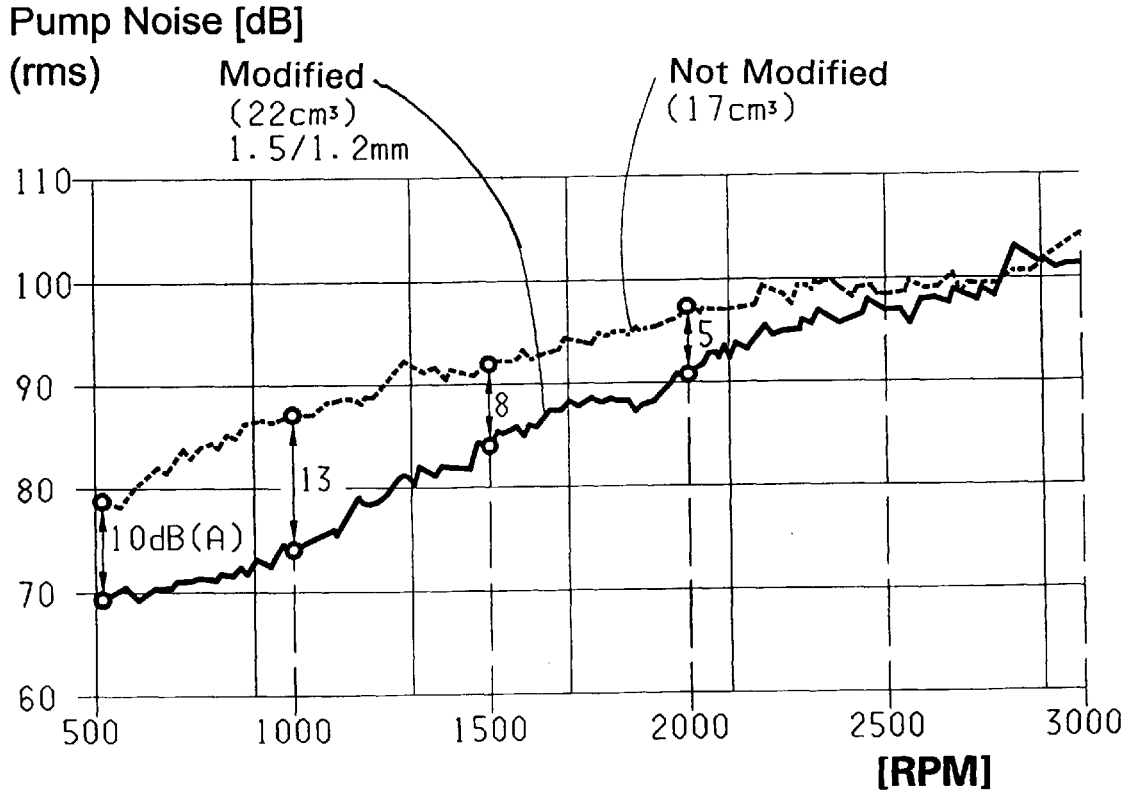
FIG. 6 is the curve of the sound pressure level for a second radial piston pump in a non-modified version and comparison to a modified version with an adapted, volumetric degree of efficiency.

A radial piston pump modified in this manner, with a compression volume of 22 $cm^3$ would be provided with relief bores of 1.5 and 1.2 mm diameters as shown in the lower curve of FIG. 6. The upper curve of FIG. 6 depicts the loss in noise level of a non-modified radial piston pump in a second embodiment with 17 $cm^3$/revolution, wherein the efficiencies of these two pumps are comparable. From the measurements so taken, the result became obvious, that the noise level of these modified pumps with 22 $cm^3$ as compared to the curves shown in FIG. 5 showed a repeated improvement. In this way, the maximum noise level reduction dropped 13 dBA, at a low rotational speed of 1000 RPM, while in FIG. 5 the maximum of 11 dBA at 1500 RPM was determined. The noise level reduction at speeds of rotation in excess of 1000 RPM is a diminishing figure, while above about 2000 RPM a reduction in noise level cannot be detected. In spite of the reduction of the volumetric efficiency, based on the same volume change operation, no increased capacity requirement in the measure of the increased compressed volume was to be expected.

Figure 7:
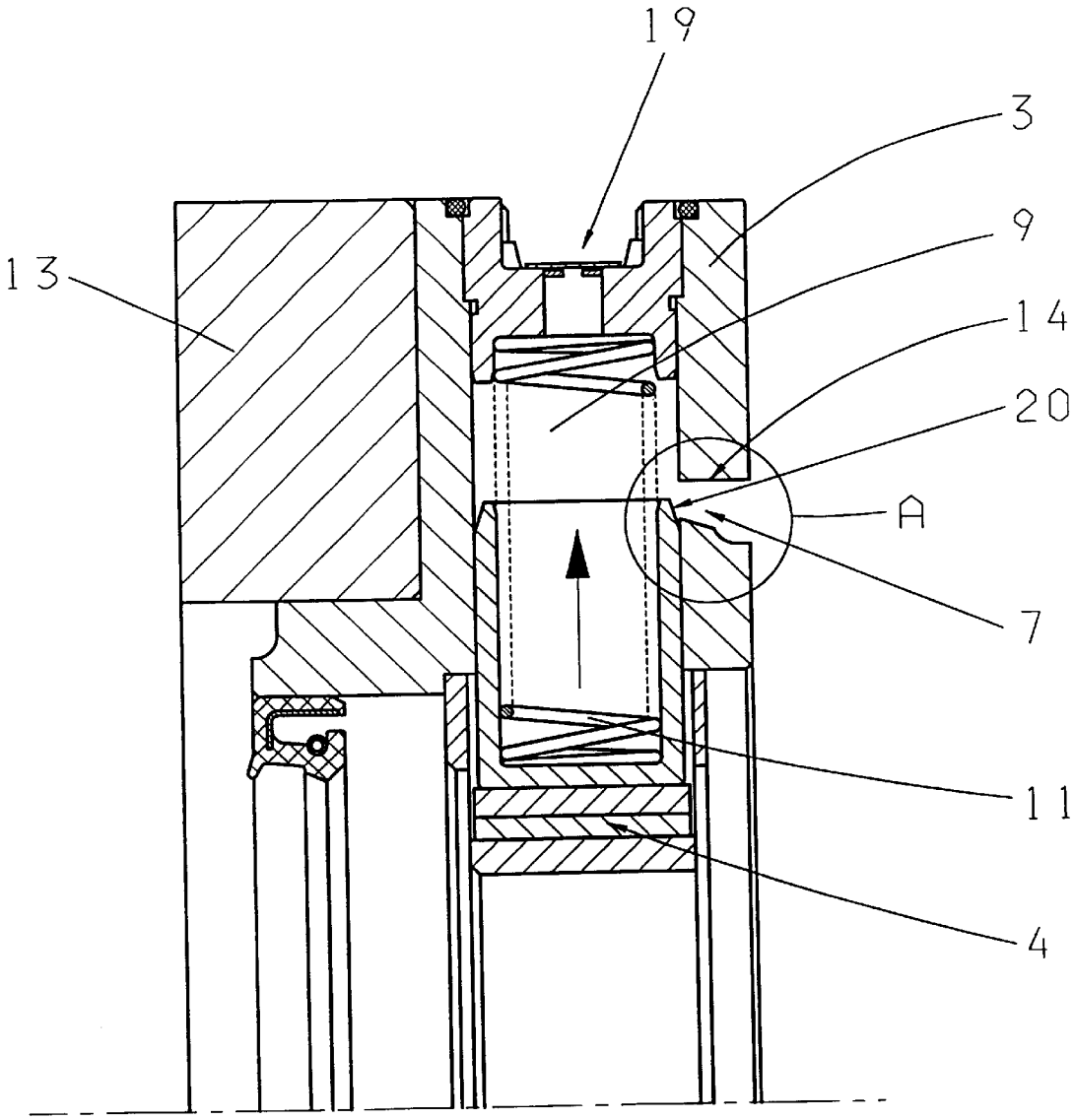
FIG. 7 is a piston-cylinder unit of a radial piston pump with a second relief opening, in accord with the invention, namely a chamfer on the piston in crosssection.

FIG. 7 shows a sectional presentation through a piston-cylinder unit of a radial piston pump, which is an alternative to that shown in FIG. 1. The pressure medium enters through the inlet window 7 as the working volumes into the cylinder inner chamber 9. A cam 4 drives the piston 6, which compresses the pressure medium, i.e. the working volume, in the cylinder inner chamber. If the piston 6 passes by the inlet window 7, and in doing this progresses outward into the inner cylinder chamber 9, then the pressure increases so greatly that the band valve 19, which is above the spring 11, is lifted.

The check valve on the pressure side is opened, since the band valve 19 over the plug is raised. Because of the stiffness of the band, and its inertia, in the inner cylinder chamber 9, it is necessary that the pressure generated must equal the system pressure, plus an additional opening pressure. Since it takes a certain time for the band valve 19 to raise to position, at that point the opening is initially very small, whereby a considerable excess pressure builds up in the inner cylinder chamber 9.

The opening mechanism can be described in this manner: the greater the opening pressure, the quicker the valve opens. If the opening time can be increased, then the opening pressure is reduced. This is achieved by the addition of a relief opening, parallel to the check valve, the open cross section of the relief opening being so measured that, on the basis of the leakage thereby caused, only such a pressure increase is attained, which lies slightly above the opening pressure of the check valve. By means of the small pressure force, the check valve opens more slowly, whereby the resisting inertia effect is likewise smaller.

A chamfer 20 on the forward rim of the piston 6, which coacts with the inlet window 7, acts in the manner of a parallel relief bore as far as the check valve is concerned, since the chamfer gives rise to a leakage into the pressure free zone.

Figure 8:
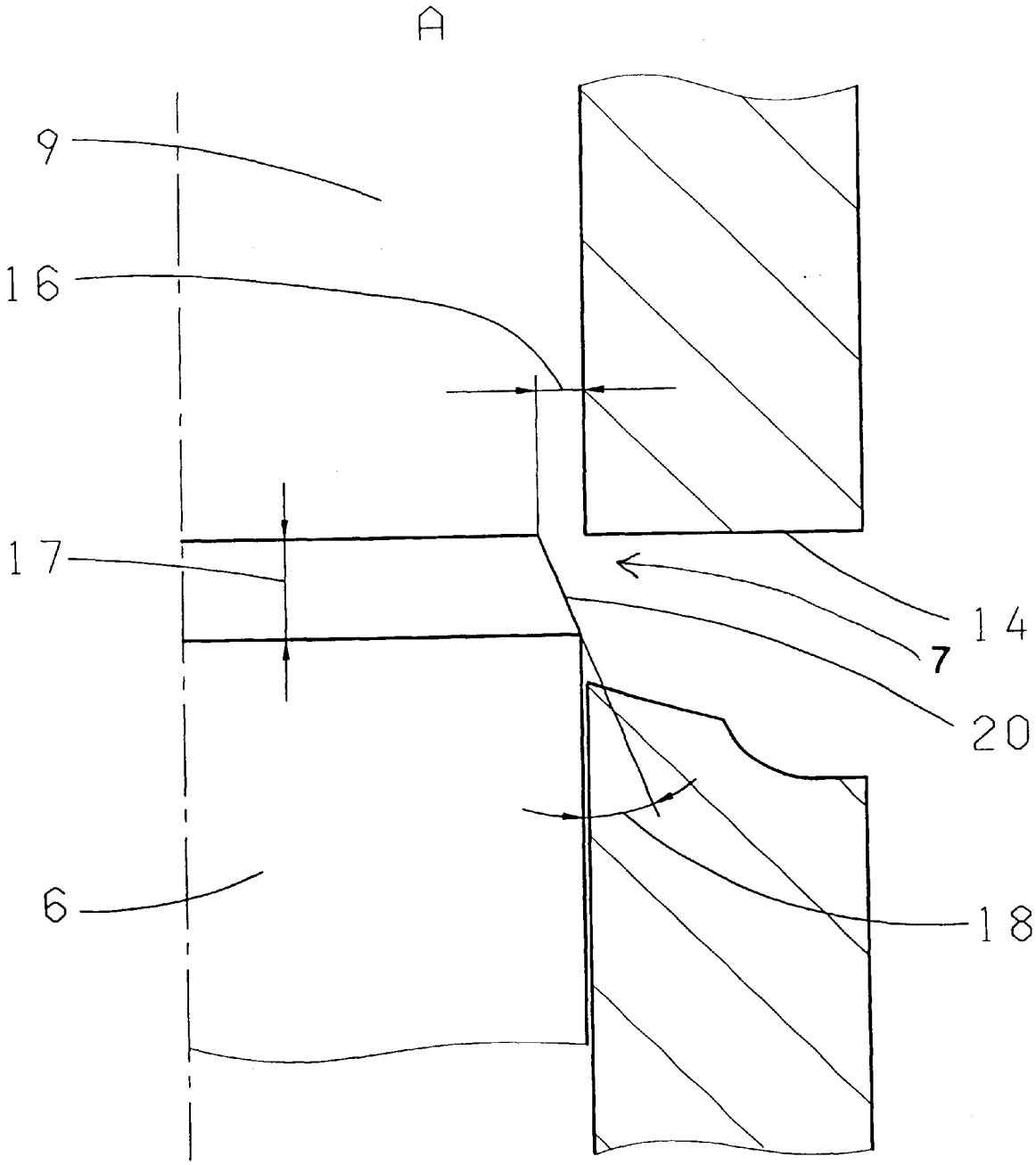
FIG. 8 is excerpt A from FIG. 7 in an enlarged presentation.

FIG. 8 depicts the section A of the FIG. 7 in greater detail. A part of the piston 7 in the cylinder inner chamber 9 is shown at the moment when it passes the inlet opening 7 during a compression stroke. On the forward edge of the piston 6, which coacts with the inlet window 7, a chamfer 20 has been added. In this embodiment, the chamfer 20 runs circumferentially about the entire rim of the outer surface of the piston 6 and is geometrically defined by the length of the chamfer 17 and the angle 18.

A leakage stream can flow, between the chamfer and the inlet control side 14, as shown in FIG. 8, which ameliorates the abrupt pressure climb of the operating volume in the cycle inner chamber 5. The annular surface between the inlet control side 14 and the chamfer 20, again as shown in FIG. 7, forms the width of the relief cross section 16 which becomes ever smaller, the more the piston 6, with its outside surface, closes the inlet opening 7.

Reference Numbers

1 radial piston pump
2 axis of rotation of drive shaft and cam 4
3 pump housing
4 cam, part of or affixed to the drive shaft
5 bore for cylinder
6 piston
7 inlet opening, i.e. inlet window
8 outlet opening, has "check valve"
9 inner space, i.e. chamber of cylinder
10 relief opening, relief bore
11 spring, forces piston 5 against cam 4
12 ring conduit
13 flange ring
14 inlet control side, remote from cam 4
15 relief opening, relief bore
16 cross-section of relief opening
17 chamfer length
18 chamfer angle
19 band valve, blocks outlet 8
20 chamfer (provides relief opening)

A enlargement of part of FIG. 7

What is claimed is:

1. A radial piston pump (1) for reduction of noise by reducing a pressure gradient during a compression stroke of a piston of the radial piston pump (1), the radial piston pump (1) comprising:

a pump housing (3); and a plurality of cylindrical bores (5) configured in a star-shape around a cam (4) and each one of the bores (5) receiving one piston, each of the bores (5) defining an inner chamber (9), for housing a compressible working volume, having an inlet valve (7) and an outlet valve (8), and each one of the bores (5) has at least one pressure relief opening for bleeding off a portion of the working volume at least during the compression stroke of the piston; wherein the piston (6) has a chamfer (20) on a forward rim which coacts with the inlet valve (7), and the chamfer (20) has a chamfer length (17) and a chamfer angle (18).

2. The radial piston pump according to claim 1, wherein the chamfer (20) is provided around an entire outer circumference of the forward rim of the piston (6).

3. The radial piston pump according to claim 1, wherein the inlet valve (7) is an inlet window (7) with an inlet control side (14).

4. The radial piston pump in accordance with claim 1, wherein the chamfer (20) of the piston (6) forms a relief cross-section of variable opening (16) with an inlet control side (14) as the chamfer length (17) of the piston (6) passes the inlet control side (14) during a compression stroke.

5. A radial piston pump (1) for reduction of noise by reducing a pressure gradient during a compression stroke of a piston of the radial piston pump (1), the radial piston pump (1) comprising:

a pump housing (3); and a plurality of cylindrical bores (5) configured in a star-shape around a cam (4) and each one of the bores (5) receiving one piston, each of the bores (5) defining an inner chamber (9), for housing a compressible working volume, having an inlet valve (7) and an outlet valve (8), and each one of the bores (5) has at least one pressure relief opening for bleeding off a portion of the working volume at least during the compression stroke of the piston; wherein the inlet valve (7) is an inlet window (7) with an inlet control side (14), and the at least one relief opening (10) is placed radially in the inner chamber (9) outside of the inlet control side (14).

6. The radial piston pump in accordance with claim 5, wherein the at least one relief opening (10) is located diametrically opposite to the inlet window (7) in the pump housing (3).

7. The radial piston pump in accordance with claim 6, wherein the relief opening (10) possesses a mirror axis aligned essentially perpendicular to a longitudinal axis of the bore (5), and at least one relief bore (10, 15) is made in the shape of one of a longitudinal slot, a slit, a lenticular or a similar opening.

8. The radial piston pump in accordance with claim 6, wherein at least one relief opening has an open cross section that tapers triangularly toward an exit opening.

9. The radial piston pump in accordance with claim 8, wherein the relief opening comprises three bores each having a central axis and arranged so that the central axis of the three bores forms a triangle.

10. The radial piston pump in accordance with claim 8, wherein the relief opening comprises a radially outward and a radially inward relief bore (10, 15) radially offset from one another, and the radially outward bore (15) has a smaller diameter than the radially inward bore (10).

11. The radial piston pump in accordance with claim 10, wherein the radially outward and the radially inward relief bores each have a diameter and a central axis, and a radial distance between the central axes of the radially outward and the radially inward relief bores is on the order of one to threefold ratio of the relief opening diameters.

12. A radial piston pump (1) for reduction of noise by reducing a pressure gradient during a compression stroke of a piston of the radial piston pump (1), the radial piston pump (1) comprising:

a pump housing (3); and a plurality of cylindrical bores (5) configured in a star-shape around a cam (4) and each one of the bores (5) receiving one piston, each of the bores (5) defining an inner chamber (9), for housing a compressible working volume, having an inlet valve (7) and an outlet valve (8), and each one of the bores (5) has at least one pressure relief opening for bleeding off a portion of the working volume at least during the compression stroke of the piston; wherein all the relief openings (10, 15) are connected together by a circumferential ring conduit (12).

13. The radial piston pump in accordance with claim 12, wherein the ring conduit (12) is located placed in a ring flange.

14. The radial piston pump in accordance with claim 5, wherein the at least one relief opening (10, 15) of each one of the bores (5) permits leakage out of the inner chamber (9) of the bore (5) into a reduced pressure zone.

* * * * *